US006125873A

United States Patent [19]

Brown

[11] Patent Number: 6,125,873

[45] Date of Patent: Oct. 3, 2000

[54] TEMPERATURE SENSING FLOW CONTROL DEVICE

[76] Inventor: Daniel H. Brown, Rte. 2 Box 273-B, Graceville, Fla. 32440

[21] Appl. No.: 09/177,907

[22] Filed: Oct. 23, 1998

[51] Int. Cl.[7] ..... F16L 55/00

[52] U.S. Cl. ..... 137/79; 137/62; 137/80

[58] Field of Search ..... 137/62, 79, 80

[56] References Cited

U.S. PATENT DOCUMENTS

| | | | |
|---|---|---|---|
| 2,291,783 | 8/1942 | Baak | 137/79 |
| 2,490,420 | 12/1949 | Davis | 137/79 |
| 3,812,872 | 5/1974 | Block et al. | 137/62 |
| 4,469,118 | 9/1984 | Walters | 137/62 |
| 4,635,668 | 1/1987 | Netter | 137/62 |
| 4,657,038 | 4/1987 | Lyons | 137/62 |
| 4,848,389 | 7/1989 | Pirkle | 137/80 |
| 5,090,436 | 2/1992 | Hoch, Jr. et al. | 137/79 |
| 5,692,535 | 12/1997 | Walters | 137/62 |
| 5,694,963 | 12/1997 | Fredell | 137/80 |

*Primary Examiner*—A. Michael Chambers
*Attorney, Agent, or Firm*—John Wiley Horton

[57] ABSTRACT

A device for preventing water line freeze damage. The device incorporates air temperature sensing means to control a trickle flow in a water system, so that a trickle flow is initiated whenever the ambient air temperature drops below a predetermined point. The trickle flow inhibits freezing in the water system.

6 Claims, 3 Drawing Sheets

TEMPERATURE SENSING FLOW CONTROL DEVICE

BACKGROUND—FIELD OF INVENTION

This invention relates to the prevention of freezing of water in residential and commercial water lines.

BACKGROUND—DESCRIPTION OF PRIOR ART

Freezing of the water contained in residential and commercial water lines is a long-recognized problem. As water freezes into ice it expands, causing great internal pressure on any pipe or valve containing it. The pipe or valve will often rupture under the stress. Because the line or valve's contents are frozen at this point, the damage may go unnoticed. However, when the ice subsequently thaws, the water will be forced out through the cracks left by the freezing, often causing considerable property damage.

There are three common approaches to preventing water line freeze damage. The first approach is to simply drain the water out of the line so that there is nothing to freeze. The second approach is to shut off the pressurized water supply without draining the water out of the lines. While this method may not prevent water line damage, it does at least prevent tremendous leakage when the frozen pipes eventually thaw.

The third approach is to provide a trickle flow through the line while keeping it full of water. This third approach relies on the fact that even a slight agitation in a body of water will significantly retard freezing. In order to freeze, the water molecules must organize themselves into a crystalline structure. A trickle flow in the water will produce mild turbulence, which will greatly inhibit the formation of an ordered crystalline structure. Thus, a trickle flow will prevent freeze-up.

Illustrating the first approach is U.S. Pat. No. 5,113,892 to Hull (1992). The Hull device uses a temperature sensor to detect an incipient freezing condition. When such a condition is detected, the device shuts off the main water line and opens a second drain valve to drain the system. Thus, the device drains all the water from the system before the water gets cold enough to freeze. While effective in preventing freeze-up, the '892 device obviously renders the water system inoperable when the temperature is near or below freezing. Thus, the Hull device has an inherent drawback in that in order to protect the water system from freezing, it must render the system inoperable. The same drawback is obviously true of every system that seeks to prevent freeze-up by draining the water from the lines.

Illustrating the second approach, shutting off the water supply without draining the lines, is U.S. Pat. No. 5,090,436 to Hoch, Jr. (1992). The Hoch device senses ambient air temperature to detect an incipient freeze. When the temperature drops below a set level, the invention electrically closes a shut-off valve to depressurize the water system. The shut-off valve will remain closed until manually reset, even if the air temperature climbs back above freezing. Thus, if there is a freeze and subsequent thaw, there will not be much flow through the ruptured pipes and there will be ample opportunity for repairs prior to repressurizing the system. As is apparent from the preceding description, however, the '436 device does not actually prevent freeze-up. It limits the damage resulting from freeze-up. While the device depressurizes the system, it does not drain the water lines.

The third approach, retarding freezing through the use of a trickle flow, has two inherent advantages over the other methods. First, the water system remains operable even though the temperature has dropped well below freezing. Second, it actually prevents freeze damage to the pipes, rather than merely restricting water flow after the damage is done. Illustrating this approach are U.S. Pat. No. 4,635,668 to Netter (1987), and U.S. Pat. No. 4,657,038 to Lyons (1987).

The Netter device senses water line temperature by using an electrical thermistor. While not specifically described, the temperature senor in the Netter device is presumably bonded to the water line itself, thereby enabling it to measure the water temperature which is conducted through the wall of the water line. This method might work satisfactorily for copper or galvanized steel pipes, but it would not work for less conductive materials such as polyvinyl chloride (PVC). For applications using PVC, which constitutes the vast majority of present construction, the sensor would have to actually be placed within the water line itself. The installer would have to bore a hole, place the water-proofed sensor in the hole, and then seal the opening.

The Lyons device takes a similar approach. A conductive metal pipe is placed downstream from a spigot valve, but upstream from the electrical trickle flow valve. A thermal switch is attached to the conductive metal pipe in order to sense the temperature of the water therein. The switch employed is a mechanical, bi-metallic type. It is set to trip at a given temperature, thereby closing a pair of electrical contacts to energize a solenoid valve. The Lyons device avoids the sensing problems inherent in the Netter device by including its own piece of conductive pipe.

While the Lyons and Netter devices are functional, they both contain two serious drawbacks. The first drawback is that the temperature sensor in each device only measures the water temperature at one stagnant point in the system. The water system is stagnant because so long as the water temperature is above freezing, the trickle valve will remain closed. Thus, the temperature sensors are only measuring the water temperature at one stagnant point in the system. There may be other points in the system where the temperature is much lower. Both devices may, in fact, not start the trickle flow until after a freeze has taken place elsewhere. And, once a portion of a water line is frozen, a trickle flow in another part of the system will not do any good.

The second serious drawback in both devices is the fact that they use water temperature to control the trickle flow instead of air temperature. By the time the water temperature approaches the freezing point, the air temperature may be well below freezing. Thus, the trickle flow is not initiated until the air temperature is below freezing. The trickle flow is much more effective in inhibiting freezing in all parts of the water system if it is initiated while the air temperature is still above freezing. This fact is true because while the air temperature is still above freezing, one can be certain that no part of the water system has fallen below freezing.

The known methods for preventing water line freeze-up damages are therefore limited in that they:

(1) Disable the operation of the water system;

(2) Do not actually prevent freeze-up;

(3) Sense water temperature in only one location, which may allow other locations to freeze; and (4) Do not initiate trickle flow until the water temperature itself is near freezing, by which time the air temperature may be well below freezing.

OBJECTS AND ADVANTAGES

Accordingly, several objects and advantages of the present invention are:

(1) to prevent freeze-up without disabling the operation of the water system;

(2) to prevent freeze up in all parts of the water system;

(3) to initiate trickle flow by sensing ambient air temperature, rather than the water temperature in the water line itself; and (4) to initiate trickle flow while the air temperature is still above freezing.

These objects and advantages will be fully explained in the details hereafter described, explained, and claimed, with reference being made to the accompanying drawings.

DRAWING FIGURES

Reference Numerals in Drawings

| | | | |
|---|---|---|---|
| 2 | trickle flow input | 4 | trickle flow output |
| 6 | solenoid valve | 8 | power switch |
| 10 | power plug | 12 | transformer |
| 14 | thermostat | 16 | thermostat adjustment |
| 18 | capillary tube sensor | 20 | outdoor spigot |
| 22 | flow splitter | 24 | manual valve |
| 26 | main water output | 28 | solenoid |
| 34 | trickle flow adjustment | 36 | solenoid electrical connectors |
| 38 | housing | 40 | lid |
| 42 | thermostat contacts | 44 | temperature sensing flow control device |
| 46 | primary coil | 48 | secondary coil |

DESCRIPTION—FIGS. 1 THROUGH 3

Figure 1:
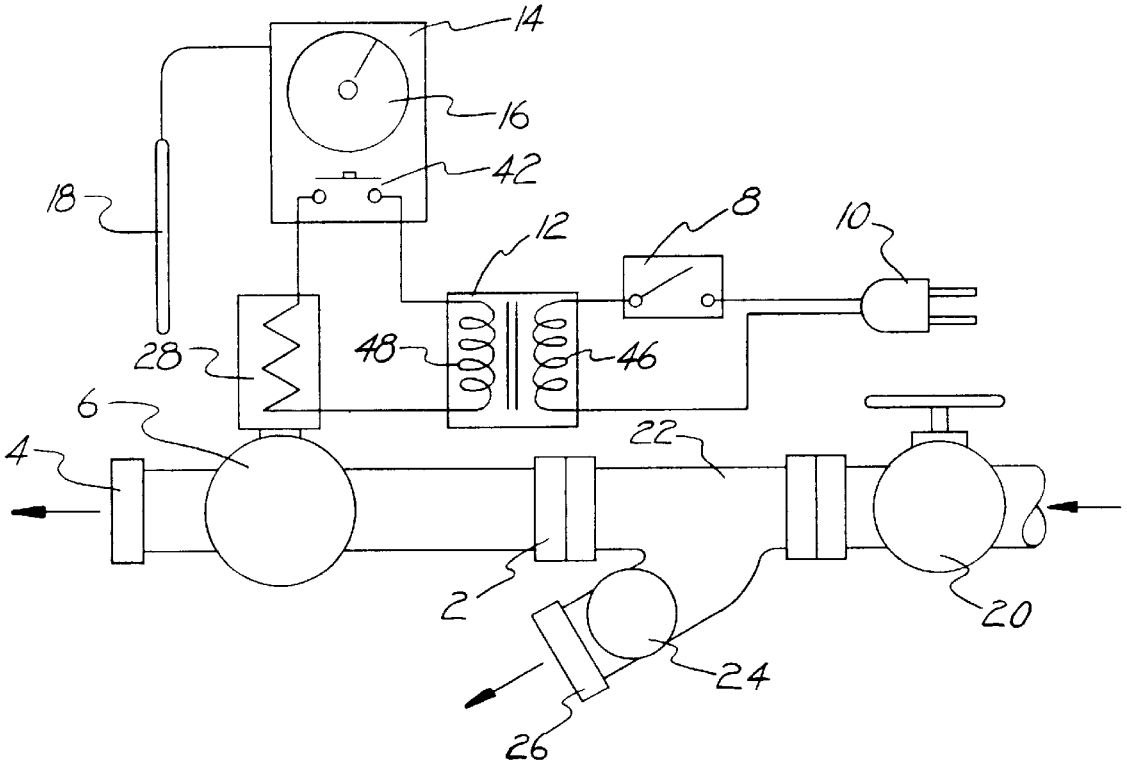
FIG. 1 is a simplified schematic view, showing how the components of the invention work together.

FIG. 1 shows a schematic representation of the invention. Flow splitter 22, is threaded onto outdoor spigot 20. Flow splitter 22 has two branches, one providing input water to trickle flow input 2, and one providing water to main water output 26. Splitter 22 also incorporates manual valve 24, which allows the user to manually control flow through main water output 26. Outdoor spigot 20 is left in the open position to provide pressure on both branches of flow splitter 22. When the user wishes to attach a hose and use outdoor spigot 20, the hose is attached to main water output 26, and flow is turned on using manual valve 24. Spigot 20 and flow splitter 22 are illustrated to show how the proposed invention may be hooked into the water system, but they are not considered part of the proposed invention.

Power plug 10 is plugged into a 110 VAC power source. It provides power, through conductive lines, to transformer 12. Power switch 8 is provided to turn the power to the invention on and off. Transformer 12 has primary coil 46 and secondary coil 48. The purpose of transformer 12 is to step down the input voltage from approximately 110 VAC in primary coil 46 to approximately 24 VAC in secondary coil 48.

Secondary coil 48 is connected to solenoid 28 in solenoid valve 6. Thermostat 14 is provided to interrupt the connection between secondary coil 48 and solenoid 28. Thermostat 14 has thermostat adjustment 16 and capillary tube sensor 18. The function of capillary tube sensor 18 is to sense ambient air temperature. Thermostat 14 also incorporates thermostat contacts 42, which make or break the connection between secondary coil 48 and solenoid 28.

Figure 2:
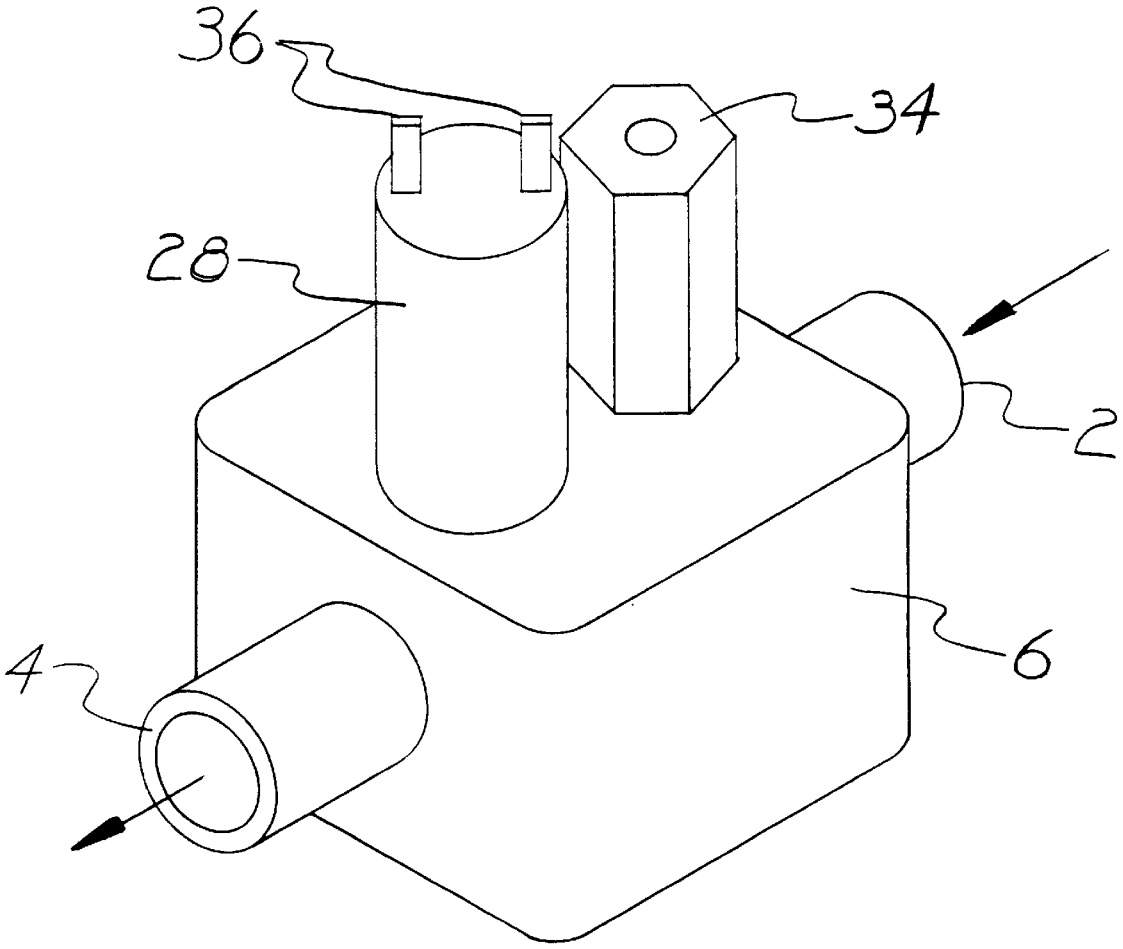
FIG. 2 is an isometric view, showing more detail of the solenoid valve.

Solenoid valve 6 is provided to control water flow from trickle flow input 2 to trickle flow output 4 FIG. 2 shows more detail of solenoid valve 6. Solenoid valve 6 has attached solenoid 28. Solenoid valve 6 is biased to return to the closed position whenever solenoid 28 is not activated. Solenoid 28 is connected to the electrical circuit shown in FIG. 1 by solenoid electrical connectors 36. Solenoid valve 6 also has triclde flow adjustment 34. Turning trickle flow adjustment 34 allows the user to set the rate of trickle flow through solenoid valve 6 when solenoid 28 is activated. The user will typically set the trickle flow to the minimum required to prevent freeze-up in the system, in order to conserve water.

All of the components listed are commercially available. In the preferred embodiment, solenoid valve 6 is a Model 075-DV from the Rainbird Corporation, thermostat 14 is a Model C12-2001 from the Ranco Corporation, and transformer 12 is a Model 4031F from the Jard Magnetics Corporation. There are many other commercial components which could be substituted for those specified, but these particular models have been found to be especially suitable.

Figure 3:
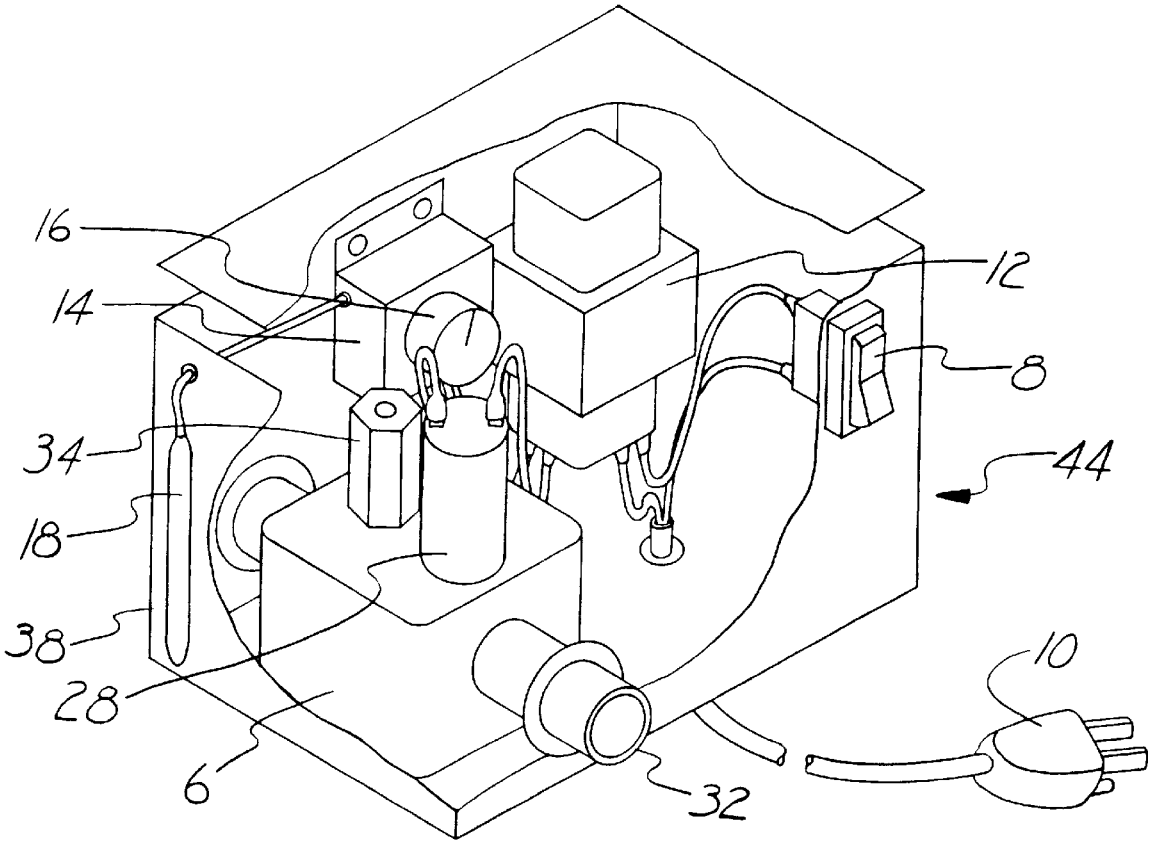
FIG. 3 is an isometric view with cutaways, showing how the components of the invention are mounted in a weather-proof housing.

Operation–FIGS. 1 through 3

Starting with FIG. 1, the operation of the invention will be described. It will be assumed that the ambient air temperature is well above freezing when the device is first installed. The user first connects flow splitter 22 to outdoor spigot 20. The user then connects trickle flow input 2 of the invention to flow splitter 22. After closing manual valve 24, the user then opens the valve on outdoor spigot 20 in order to pressurize trickle flow input 2. Power plug 10 is then plugged into a 110 VAC electrical receptacle. The user then turns on the device by activating power switch 8.

Once power switch 8 is turned on, transformer 12 is energized, which creates 24 VAC of potential in secondary coil 48. The device is operational at this point. There is no current flow through secondary coil 48, however, because thermostat contacts 42 in thermostat 14 are normally in the open position, as shown. The finction of thermostat 14 is to close thermostat contacts 42 when the ambient air temperature falls below a certain point, which will be referred to as the "actuation temperature." Thermostat 14 has attached capillary tube sensor 18, which senses the ambient air temperature. Thermostat 14 also has thermostat adjustment 16, which the user can employ to set the actuation temperature. Thermostat adjustment 16 can preferably be adjusted over a broad range of temperature near the freezing point of water. For example, thermostat adjustment 16 could provide for settings between 30 and 40 degrees Fahrenheit. Scribe marks indicating the temperature setting are provided on thermostat adjustment 16 to assist the user in setting the actuation temperature.

Once the user sets the actuation temperature, the device is left unattended. At some later time, when the ambient air temperature drops to the actuation temperature, thermostat contacts 42 in thermostat 14 will close. Current will then began flowing in the completed circuit from secondary coil 48 to solenoid 28. Once solenoid 28 is energized, normally-closed solenoid valve 6 is opened and water flows from trickle flow input 2 to trickle flow output 4. The trickle flow is maintained for as long as the ambient air temperature remains at or below the actuation temperature.

Turing now to FIG. 2, some further details of the invention will be described. Different levels of trickle flow are needed to prevent freeze-up in different water systems. It is therefore desirable to have an adjustment for the rate of trickle flow once solenoid valve 6 is opened. Solenoid valve 6 has trickle flow adjustment 34 located on its upper surface. By rotating trickle flow adjustment 34, the user may easily regulate the level of trickle flow.

The reader will appreciate that the various components described must be housed to prevent exposure to the weather. Turning to FIG. 3, a suitable housing will be described. Housing 38 is a rectangular box which is open on the top. Lid 40 is sized to fit over and seal the open top of housing 38. Housing 38 and lid 40 are preferably made of sheet metal with an appropriate anti-corrosion coating. However, housing 38 and lid 40 could also be made of plastic or other materials.

The various components of the invention are mounted to the walls of housing 38. The positioning of the components is not critical, so long as the user has access to adjust thermostat adjustment 16 and to remove any component that must be repaired or replaced. Capillary tube sensor 18 is shown mounted on the outside wall of housing 38. It is possible, however, to remotely locate capillary tube sensor 18. Extended tubes are available which would allow it to be mounted many feet away from housing 38. In some situations, it may be desirable to mount capillary tube sensor 18 on a north wall, or other location where the ambient air temperature is typically lowest.

The completed invention, housed within housing 38, weighs several pounds. It may therefore be inadvisable to hang this weight off outdoor spigot 20 without additional support. Various bracket can be attached to housing 38 and these brackets may then in turn be attached to a wooden or brick outside wall of a building. As such brackets are well known in the prior art, they have not been illustrated.

The reader will appreciate that the preferred embodiment described is intended to be mounted outside a building. The invention could, however, quite easily be adapted to mount inside a building. The only needed modifications would be to mount capillary tube sensor 18 remotely, on the outside of the building, and to provide a suitable drain for trickle flow output 4. Capillary tube sensor 18 is readily available in lengths of five feet or more, so placing the sensor outside the building in a location remote from housing 38 would not be a problem.

From the preceding descriptions, a number of advantages of the proposed invention are apparent:

1. The device prevents freeze-up without disabling the operation of the water system;
2. When properly installed and adjusted, the device will prevent freeze up in locations remote from the device itself;
3. The device initiates trickle flow by sensing ambient air temperature, rather than the water temperature in the water line itself; and
4. The device may be set to initiate trickle flow while the air temperature is still above freezing.

SUMMARY, RAMIFICATIONS, AND SCOPE

Accordingly, the reader will appreciate that the proposed invention can prevent eliminate the damage caused by frozen water lines. Once the device is installed and adjusted, the user no longer has to manually open a spigot in order to impede freezing. Furthermore, the proposed invention has additional advantages in that:

1. It may be installed in a vacation home or other building which may be left unattended for extended periods;
2. The temperature sensor employed may be remotely located so that it can be placed to sense the lowest ambient air temperature around the building;
3. The user can adjust the rate of trickle flow when the solenoid valve is actuated; and
4. The user can adjust the actuation temperature in order to adapt the invention to a particular water system's needs.

Although the preceding description contains significant detail, it should not be construed as limiting the scope of the invention but rather as providing illustrations of the preferred embodiment of the invention. For example, a different type of ambient air temperature sensor could be used, the invention could be equipped for DC battery power, etc. Thus, the scope of the invention should be fixed by the following claims, rather than by the examples given.

Having described my invention, I claim:

1. An outside air temperature-sensing trickle flow device designed to be attached to a spigot in a water system, so that trickle flow is initiated when the outside air temperature reaches a set actuation temperature, comprising:

a. a solenoid valve, attached to said spigot, movable between open and closed positions, and being normally in the closed position;

b. a solenoid, mechanically connected to said solenoid valve to move said solenoid valve from said closed position to said open position when said solenoid is energized, said solenoid valve being biased to return to the closed position when said solenoid is deenergized;

c. an electrical power supply means for energizing said solenoid;

d. outside air temperature sensing means;

e. electrical control means, for connecting said electrical power supply means to said solenoid when said outside air temperature sensing means senses said set actuation temperature, so that said solenoid is energized, thereby opening said solenoid valve and allowing a trickle flow of water from said spigot to pass through said solenoid valve.

2. The device as recited in claim 1, wherein said electrical power supply means comprises a transformer, with the primary coil of said transformer being electrically connected to a 110 VAC electrical outlet.

3. The device as recited in claim 1, wherein said outside air temperature sensing means comprises a capillary tube sensor.

4. The device as recited in claim 1, wherein said electrical control means comprises a thermostat, attached to said outside air temperature sensing means, having a set of thermostat contacts for making an electrical circuit between said power supply means and said solenoid when said outside air temperature sensing means senses that the outside air temperature is equal to or less than said actuation temperature, and for breaking said electrical circuit once the outside air temperature climbs above said actuation temperature.

5. The device as recited in claim 4, wherein said thermostat further comprises mechanical thermostat adjustment means allowing the user to alter said actuation temperature.

6. The device as in claim 1, wherein said solenoid valve further comprises a trickle flow adjustment, allowing the user to adjust the rate of trickle flow when said solenoid valve is in the open position.

* * * * *